US011693348B2

(12) United States Patent
Kawasaki et al.

(10) Patent No.: US 11,693,348 B2
(45) Date of Patent: Jul. 4, 2023

(54) IMAGE FORMING APPARATUS

(71) Applicant: CANON KABUSHIKI KAISHA, Tokyo (JP)

(72) Inventors: Yasuhiro Kawasaki, Kanagawa (JP); Yohei Suzuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/365,894

(22) Filed: Jul. 1, 2021

(65) Prior Publication Data

US 2022/0011707 A1 Jan. 13, 2022

(30) Foreign Application Priority Data

Jul. 10, 2020 (JP) ..... 2020-119404

(51) Int. Cl.
*G03G 15/00* (2006.01)

(52) U.S. Cl.
CPC ..... *G03G 15/6529* (2013.01)

(58) Field of Classification Search
CPC combination set(s) only.
See application file for complete search history.

(56) References Cited

U.S. PATENT DOCUMENTS

2009/0022514 A1* 1/2009 Fujiwara ..... G03G 21/168 399/121
2014/0210159 A1* 7/2014 Kobayashi ..... G03G 21/1695 271/226

FOREIGN PATENT DOCUMENTS

| | | | |
|---|---|---|---|
| JP | 2001026341 A | | 1/2001 |
| JP | 2006321650 A | | 11/2006 |
| JP | 2009145469 A | | 7/2009 |
| JP | 2015068992 A | * | 4/2015 |
| JP | 2017178549 A | * | 10/2017 |
| JP | 2018065258 A | | 4/2018 |

* cited by examiner

*Primary Examiner* — Jennifer Bahls
(74) *Attorney, Agent, or Firm* — Canon U.S.A., Inc. I.P. Division

(57) ABSTRACT

An image forming apparatus includes an image forming unit to form an image on a sheet, a conveyance guide unit, and a conveyance unit. The conveyance guide unit conveys the sheet on which the image is to be formed by the image forming unit. The conveyance unit conveys the sheet toward a first conveyance guide unit. The conveyance guide unit includes an urging member, a rotary member to be urged by the urging member and to rotate while abutting the sheet, a holding unit holding the urging member and the rotary member, and the first conveyance guide unit that is detachably attached to the holding unit to guide the sheet. The first conveyance guide unit includes a pressed portion, and the pressed portion is to be pressed by the sheet conveyed by the conveyance unit and has strength less than strength of the holding unit.

11 Claims, 13 Drawing Sheets

IMAGE FORMING APPARATUS

BACKGROUND

Field

The present disclosure relates to an image forming apparatus.

Description of the Related Art

In an image forming apparatus, a conveyance guide is disposed to covey a sheet and the sheet is conveyed while being in contact with the conveyance guide. As the sheet conveyance continues, the conveyance guide is abraded, which can lead to a paper jam or image defect.

Japanese Patent Application Laid-Open No. 2006-321650 discusses a configuration in which a part to be in hard contact with a sheet in a conveyance guide unit is a detachable conveyance guide with higher rigidity.

However, in a case where the conveyance guide unit is partially worn down by contact between the conveyance guide unit and a sheet, an image defect can occur.

SUMMARY

According to an aspect of the present disclosure, an image forming apparatus includes an image forming unit configured to form an image on a sheet, a conveyance guide unit configured to convey the sheet on which the image is to be formed by the image forming unit, and a conveyance unit configured to convey the sheet toward a first conveyance guide unit, wherein the conveyance guide unit includes an urging member, a rotary member configured to be urged by the urging member and to rotate while abutting the sheet, a holding unit holding the urging member and the rotary member, and the first conveyance guide unit that is detachably attached to the holding unit to guide the sheet, and wherein the first conveyance guide unit includes a pressed portion, and the pressed portion is to be pressed by the sheet conveyed by the conveyance unit and has strength less than strength of the holding unit.

DESCRIPTION OF THE EMBODIMENTS

Figure 1:
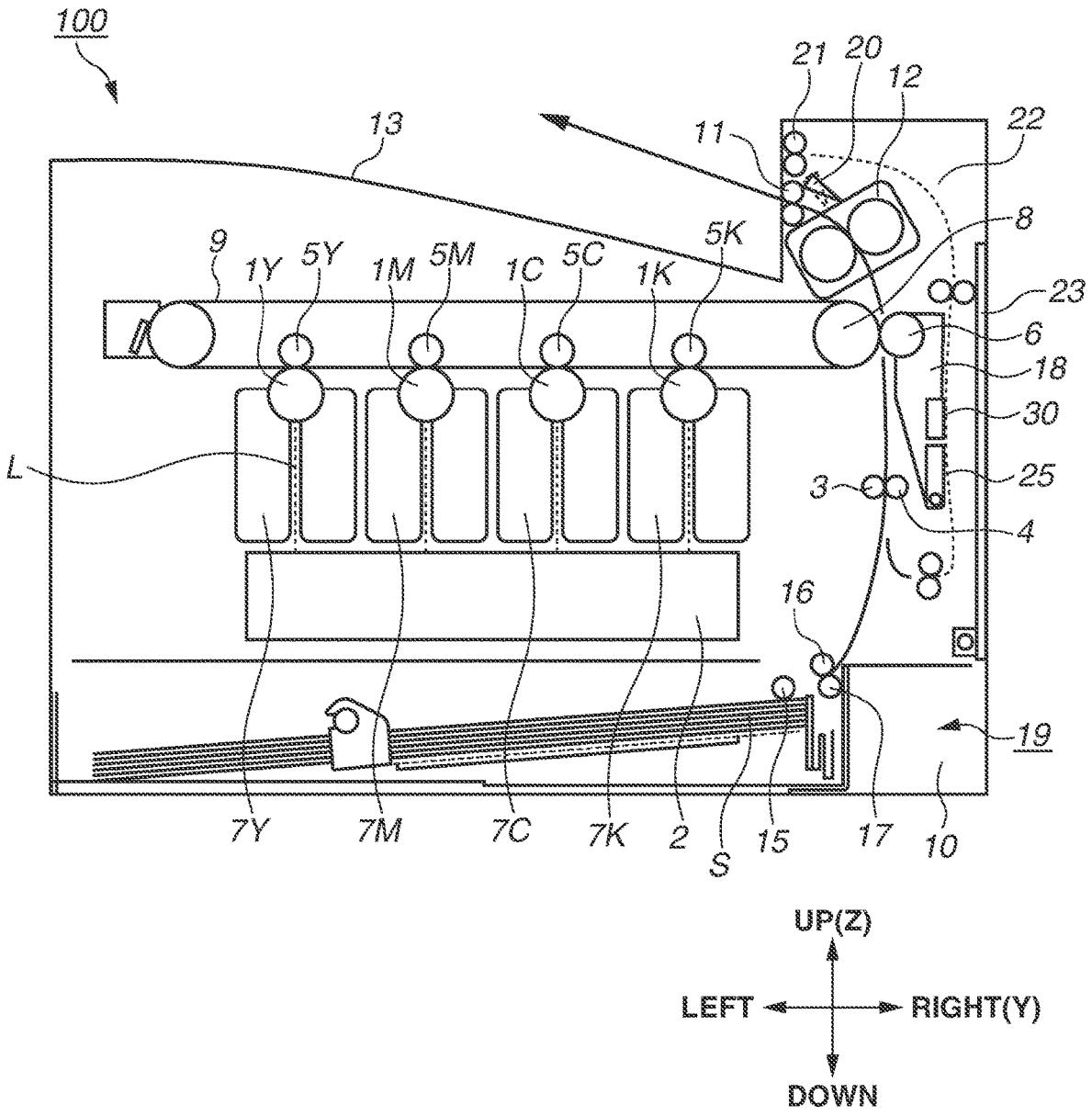
FIG. 1 is a schematic cross-sectional view of an overall apparatus configuration according to a first exemplary embodiment.

Exemplary embodiments will be described in detail below with reference to the attached drawings. The following exemplary embodiments are not intended to limit the disclosure according to the scope of claims. A plurality of features is described in the exemplary embodiments, but not all of these features are necessarily required for the disclosure, and the plurality of features may be freely combined. Further, in the attached drawings, identical or similar configurations will be assigned the same reference number, and the description thereof will not be repeated. Three arrows indicating an x-direction, a y-direction, and a z-direction can be illustrated in the drawings. These arrows will help understanding of the positions of the respective members.

FIG. 1 is a schematic cross-sectional view of a laser beam printer that is an example of an image forming apparatus 100 (hereinafter may be referred to as the printer 100). In the present exemplary embodiment, a full color printer will be described as an example, but a monochrome laser beam printer or other type of image forming apparatus, e.g., an inkjet type, can be used.

Sheets S are stacked in a feeding cassette 10. The sheets S are fed by a pickup roller 15. The fed sheets S are separated one by one by a separation unit 19 consisting of a conveyance roller 16 and a separation roller 17 containing a torque limiter. Afterward, a registration roller 3 and a registration roller 4 perform skew correction, and the sheet is subsequently conveyed to a secondary transfer portion.

The printer 100 includes a photosensitive drum 1 serving as an image bearing member inside a process cartridge 7. The process cartridge 7 corresponds to each of four colors of yellow (Y), magenta (M), cyan (C), and black (K). In FIG. 1, a reference character representing a color (Y, M, C, or K) follows the reference numeral of the corresponding member, so that a member of a specific color is distinguished from the others. For example, the photosensitive drum of yellow is represented by 1Y. In the following, in a case where it is not necessary to distinguish a member of a specific color from the others, the reference character (Y, M, C, or K) representing the color will be omitted.

A charging roller (not illustrated) inside the process cartridge 7 charges a surface of the photosensitive drum 1. A laser scanner unit 2 emits laser light L onto the photosensitive drum 1 based on image information, thereby forming an electrostatic latent image on the photosensitive drum 1. A development roller (not illustrated) inside the process cartridge 7 visualizes the electrostatic latent image formed on the photosensitive drum 1 using toner, so that a toner image is formed. The toner images of the respective colors thus formed on the photosensitive drums 1 are sequentially superimposed on each other on an intermediate transfer belt 9 and are each thereby primarily transferred thereto by primary transfer rollers 5, so that a color toner image is formed. The intermediate transfer belt 9 is rotated by a drive roller 8, and the color toner image formed on the intermediate transfer belt 9 is transferred to the sheet S by a secondary transfer roller 6 serving as a secondary transfer member held in a secondary transfer unit 18. In the present exemplary embodiment, an image forming unit that forms an image on a sheet is composed of each of the process cartridges 7 and the intermediate transfer belt 9.

These image forming units form the image on the sheet S. Downstream from the secondary transfer portion is a fixing unit 12 that fixes the toner image on the sheet S by heat. In one-sided printing, the sheet S is ejected to a sheet discharge tray 13 through a sheet discharge unit 11. The sheet S is conveyed below the under surface of a flapper 20 to the sheet discharge unit 11.

Meanwhile, in two-sided printing, the flapper 20 is operated to be in a position indicated by a dotted line in FIG. 1 to change a conveyance path, so that the sheet S is conveyed above the top surface of the flapper 20 to a reversing roller pair 21, and the reversing roller pair 21 conveys the sheet S in the reverse direction (switch-back conveyance). The sheet S conveyed in the reverse direction is sent into the image forming unit again through a two-sided conveyance path 22, so that the image is also formed on the second side. The main body of the apparatus (the printer 100) includes an opening/closing door 23 serving as an opening/closing member. In a case where the sheet S is jammed for some reason, a user opens the opening/closing door 23 and removes the jammed sheet S.

The secondary transfer unit 18 serving as a conveyance guide unit of the present exemplary embodiment will be described. The secondary transfer unit 18 includes the secondary transfer roller 6 serving as a rotary member, and an urging member (not illustrated) that urges the secondary transfer roller 6 toward the intermediate transfer belt 9. The secondary transfer roller 6 abuts the sheet S, and forms the secondary transfer portion with the intermediate transfer belt 9. The secondary transfer unit 18 further includes a guide unit that guides the sheet S passing on the two-sided conveyance path 22, on the opening/closing door 23 side. The guide unit of the present exemplary embodiment includes at least a detachable guide 30 serving as a first conveyance guide unit and detachable from the main body (a holding unit) of the secondary transfer unit 18, and a conveyance guide 25 serving as a second conveyance guide unit and disposed downstream from the detachable guide 30 in the conveyance direction.

It may be desirable to apply a large pressure to the secondary transfer roller 6 so that the toner image formed on the intermediate transfer belt 9 is transferred to the sheet S by the secondary transfer roller 6. In the present exemplary embodiment, a compression spring (not illustrated) serving as the urging member urges the secondary transfer roller 6 toward the intermediate transfer belt 9 by applying a pressure of about 5 kilogram-force (kgf) thereto. Therefore, it may be desirable to use a material having high rigidity for the secondary transfer unit 18 so as to be able to withstand a high pressure. To increase the rigidity of the material, there can be used a method of adding a filler (such as glass fiber, carbon fiber, or potassium titanate) that can increase the rigidity to the material and molding the material.

In the present exemplary embodiment, the secondary transfer unit 18 is configured by molding acrylonitrile butadiene styrene (ABS) to which the glass fiber is added as the filler. However, in a case where the filler is added to the material, the filler can project from a surface to be in contact with the sheet S when the conveyance surface is worn down by continuous conveyance of the sheet S. When the sheet S comes into contact with the filler, an image defect can occur.

Figure 2:
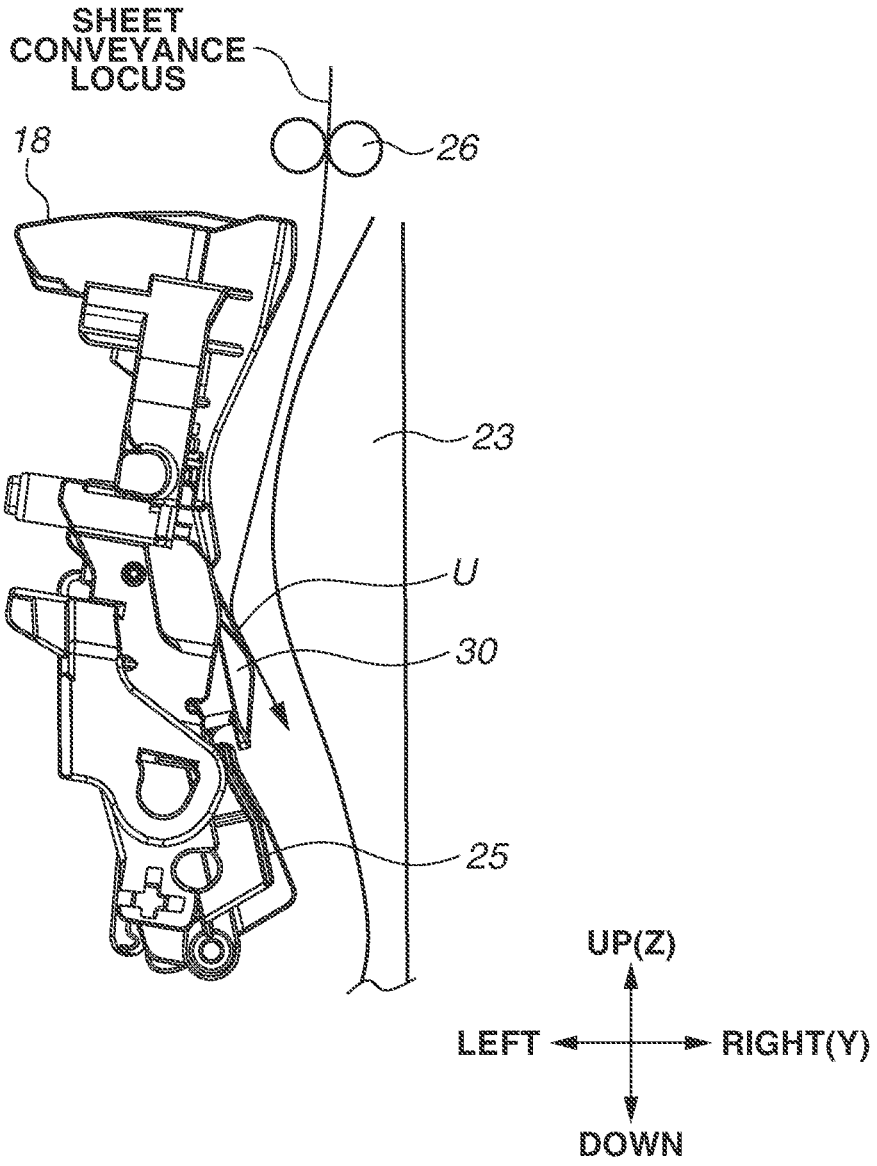
FIG. 2 is a schematic side view of a secondary transfer unit of the first exemplary embodiment.

FIG. 2 illustrates a schematic side view of the secondary transfer unit 18. In the present exemplary embodiment, there is used a configuration in which the sheet S sent out by a conveyance roller 26 serving as a conveyance unit comes into hard contact with a contact portion U to prevent skew of the sheet S on the two-sided conveyance path 22. In other words, the conveyance roller 26 is a conveyance unit that conveys a sheet toward the detachable guide 30, and the contact portion U is a pressed portion to be pressed by the sheet conveyed by the conveyance roller 26.

The contact portion U in hard contact with the sheet S can be abraded by continuous conveyance of the sheet S. Therefore, in the present exemplary embodiment, the contact portion U to be in hard contact with the sheet S is a part of the detachable guide 30 detachably attached to the secondary transfer unit 18. Further, a material not including the filler is used for the detachable guide 30, and therefore, the detachable guide 30 has strength less than that of the secondary transfer unit 18.

Because the material not including the filler is used for the detachable guide 30, damage to the sheet S and damage to an image formed on the sheet S can be limited even if the conveyance surface is worn down, so that an image defect can be suppressed. Further, in a case where the amount of abrasion of the detachable guide 30 increases thereby affecting the conveyance of the sheet S in contact with the detachable guide 30, the abraded detachable guide 30 can be detached from the secondary transfer unit 18 and a new detachable guide can be attached. The configuration in which the entire detachable guide 30 does not include the filler is described, but a configuration in which only the contact portion U of the detachable guide 30 does not include the filler may be adopted.

Figure 3A:
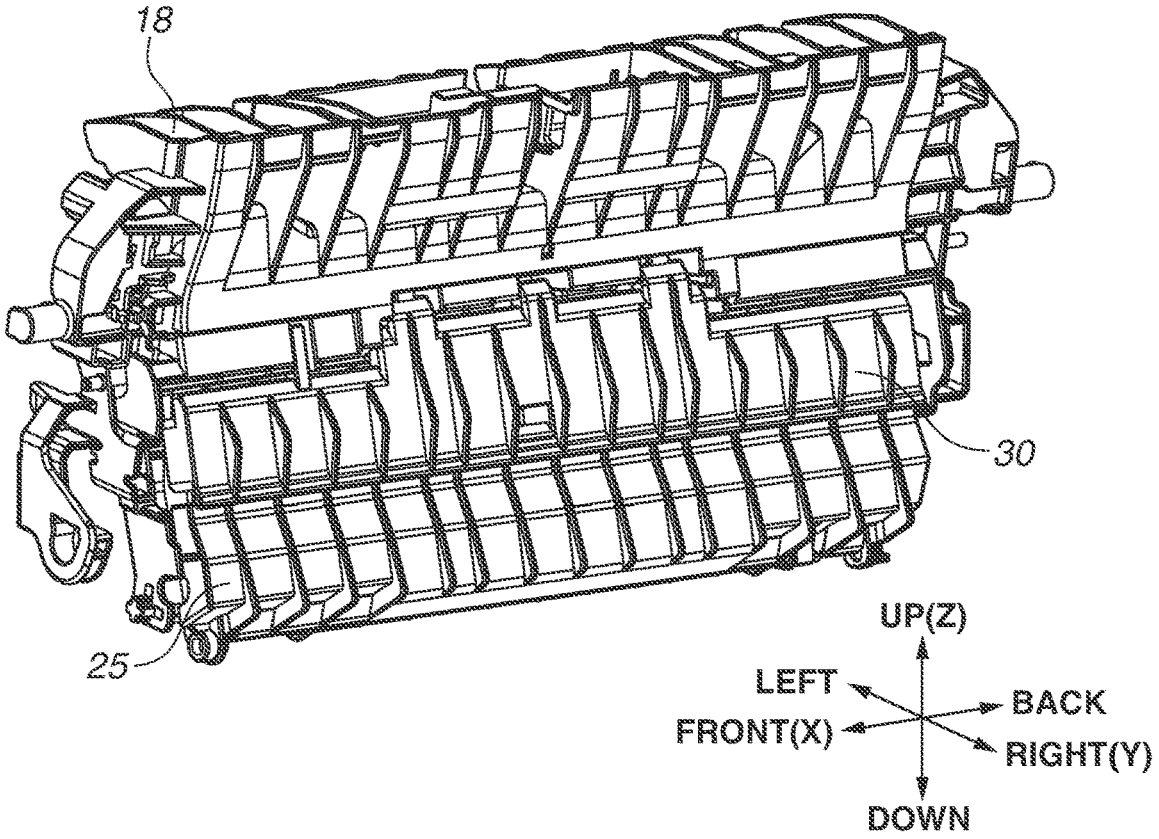
FIG. 3A is a perspective view illustrating a relationship among a detachable guide, a conveyance guide, and the secondary transfer unit.
Figure 3B:
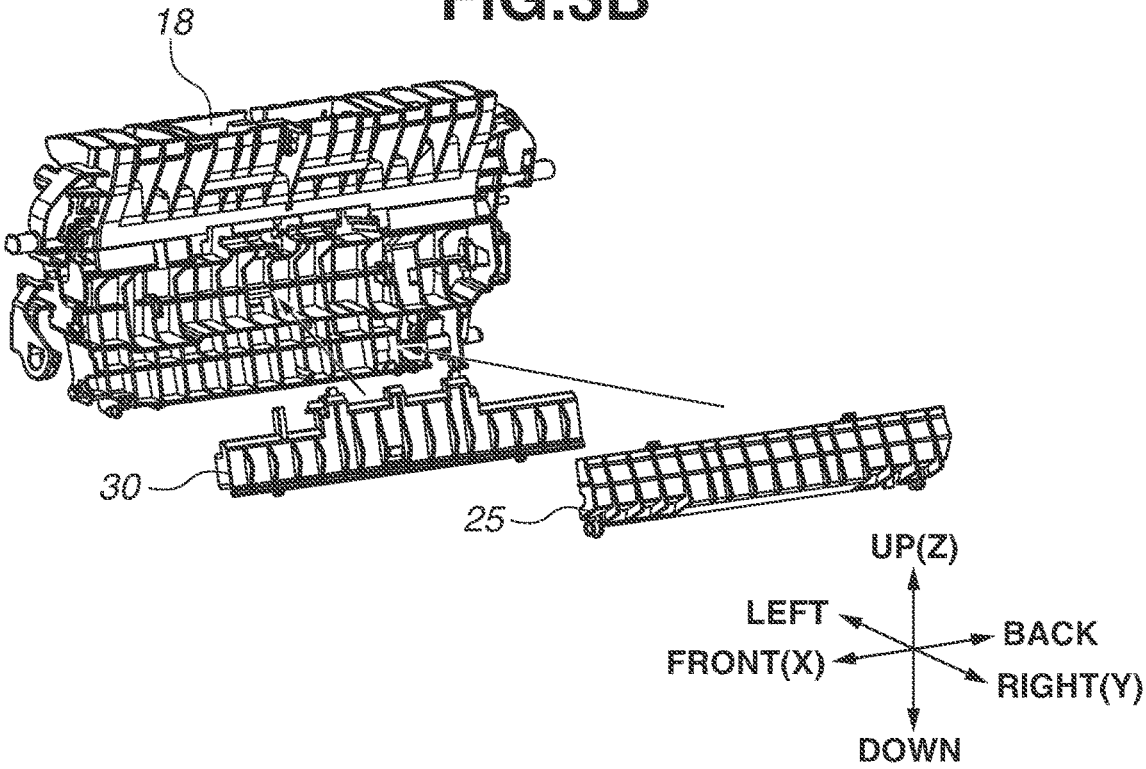
FIG. 3B is a perspective view illustrating a state where the detachable guide and the conveyance guide are detached from the secondary transfer unit.

In the present exemplary embodiment, ABS, or polycarbonate and ABS (PC+ABS), is used as the material of the detachable guide 30. FIG. 3A illustrates an overall perspective view of the secondary transfer unit 18 to which the detachable guide 30 and the conveyance guide 25 are attached, and FIG. 3B illustrates an overall perspective view of the secondary transfer unit 18 from which the detachable guide 30 and the conveyance guide 25 are detached. The conveyance guide 25 is rotatable relative to the secondary transfer unit 18, and is made of the same material as the secondary transfer unit 18.

Figure 4A:
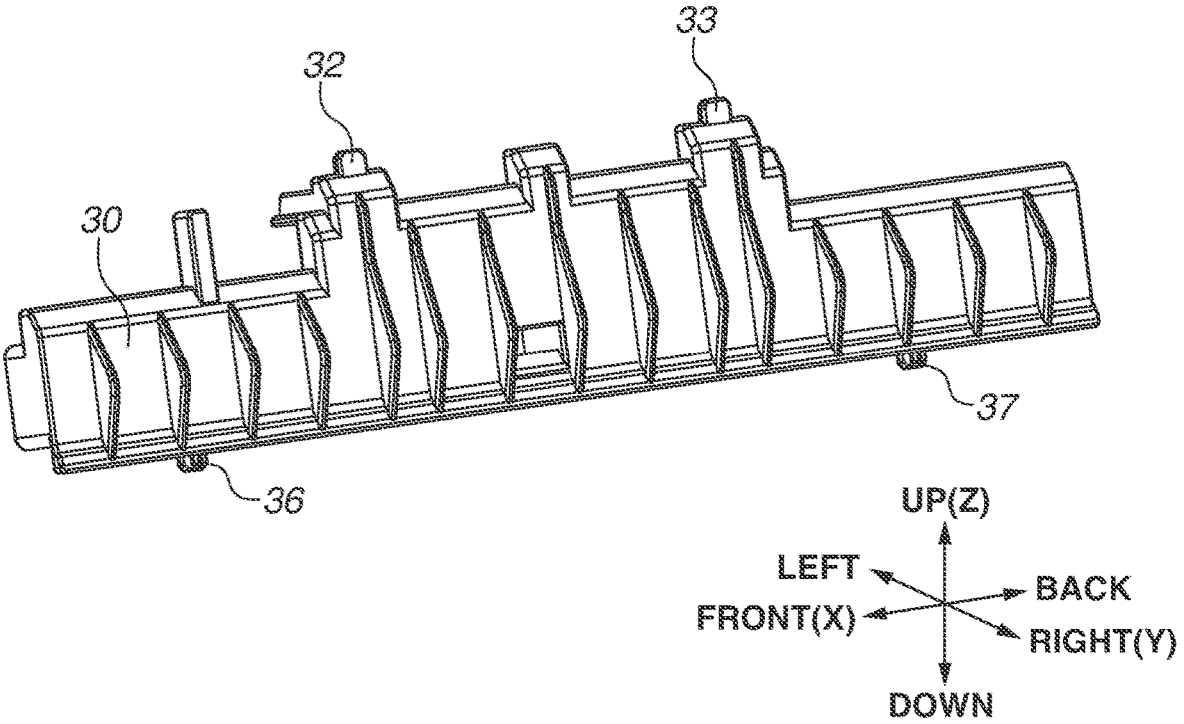
FIG. 4A is a perspective view of the detachable guide.
Figure 4B:
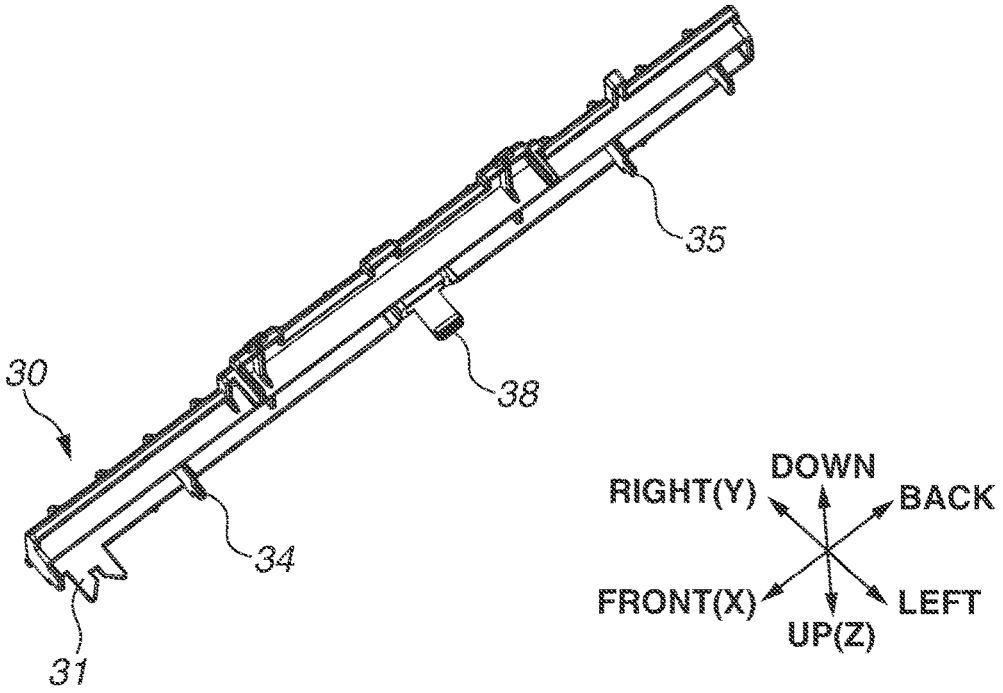
FIG. 4B is a perspective view of the detachable guide as viewed from a different angle.

Next, a configuration of the detachable guide 30 will be described. FIGS. 4A and 4B each illustrate a perspective view of the detachable guide 30. The detachable guide 30 includes a rib 31 serving as a first portion-to-be-positioned for positioning relative to the secondary transfer unit 18 in the X-direction, and ribs 34 and 35 serving as a second portion-to-be-positioned for positioning in the z-direction. The detachable guide 30 further includes retentions rib 32 and 33 for preventing disengagement from the secondary transfer unit 18, as a first retention portion. The detachable guide 30 further includes retention ribs 36 and 37 and an engagement claw 38 for preventing disengagement from the conveyance guide 25, as a second retention portion.

Figure 5A:
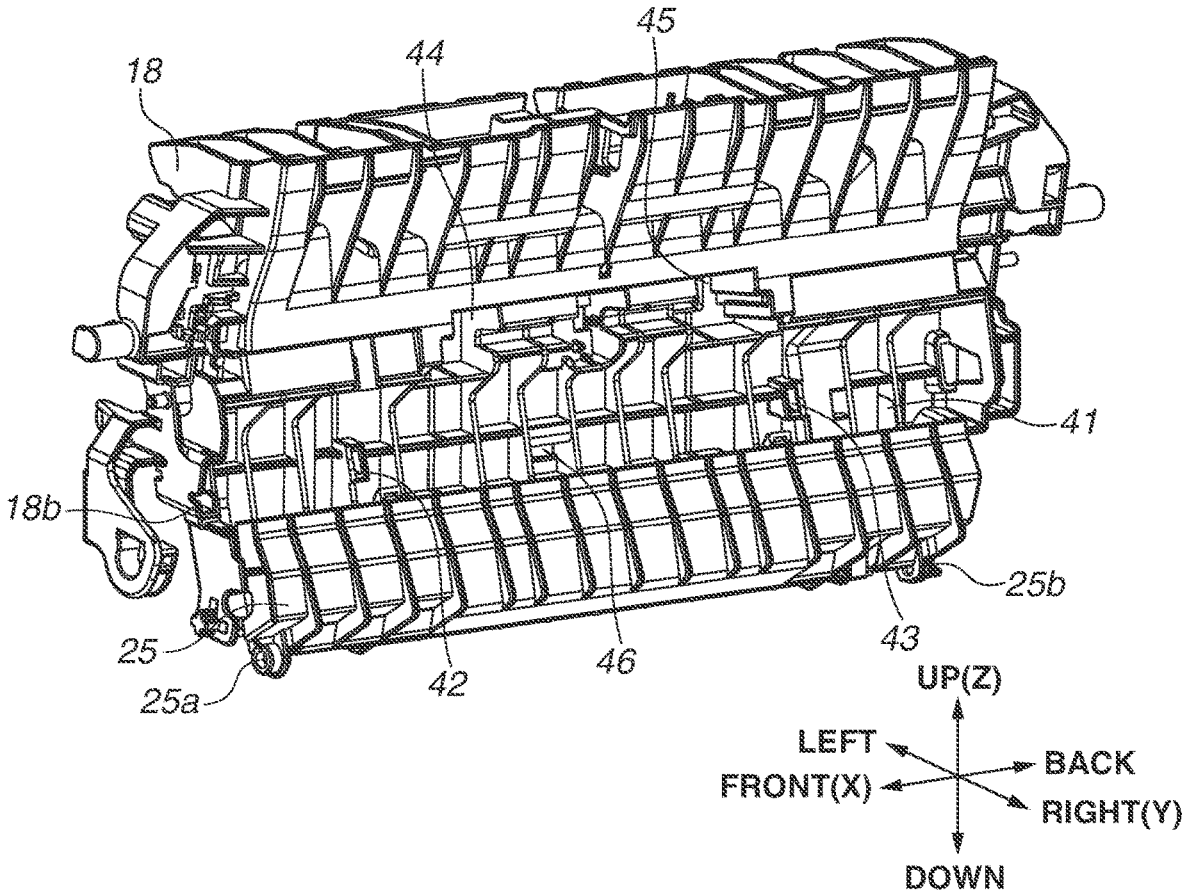
FIG. 5A is a perspective view of the secondary transfer unit to which only the conveyance guide is attached.
Figure 5B:
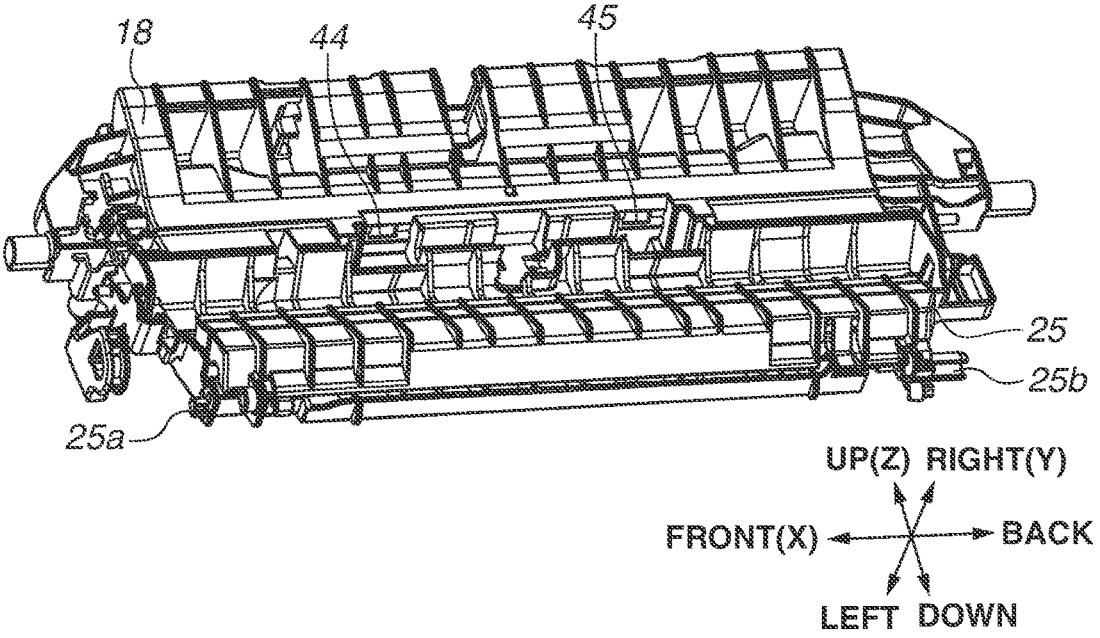
FIG. 5B is a perspective view of the secondary transfer unit to which only the conveyance guide is attached as viewed from an angle different from that in FIG. 5A.

FIG. 5A is a perspective view of the secondary transfer unit 18 to which only the conveyance guide 25 is attached, and FIG. 5B is a perspective view of the secondary transfer unit 18 to which only the conveyance guide 25 is attached, as viewed from an angle different from that in FIG. 5A. The secondary transfer unit 18 includes a rib 41 as a first positioning portion, and recess portions 42 and 43 as a second positioning portion. The secondary transfer unit 18 further includes hole portions 44 and 45 as a first regulation portion, and a hole portion 46 as a second regulation portion. The rib 41 positions the detachable guide 30 in the x-direction by engaging with the rib 31 of the detachable guide 30. The recess portions 42 and 43 position the detachable guide 30 in the z-direction by engaging with the ribs 34 and 35 of the detachable guide 30. The retention ribs 32 and 33 of the detachable guide 30 are inserted into the hole portions 44 and 45, and the engagement claw 38 of the detachable guide 30 is inserted into the hole portion 46, so that the detachable guide 30 is prevented from disengaging from the secondary transfer unit 18. Further, the conveyance guide 25 rotates about coaxial bosses 25*a* and 25*b*, relative to the secondary transfer unit 18.

Figure 6A:
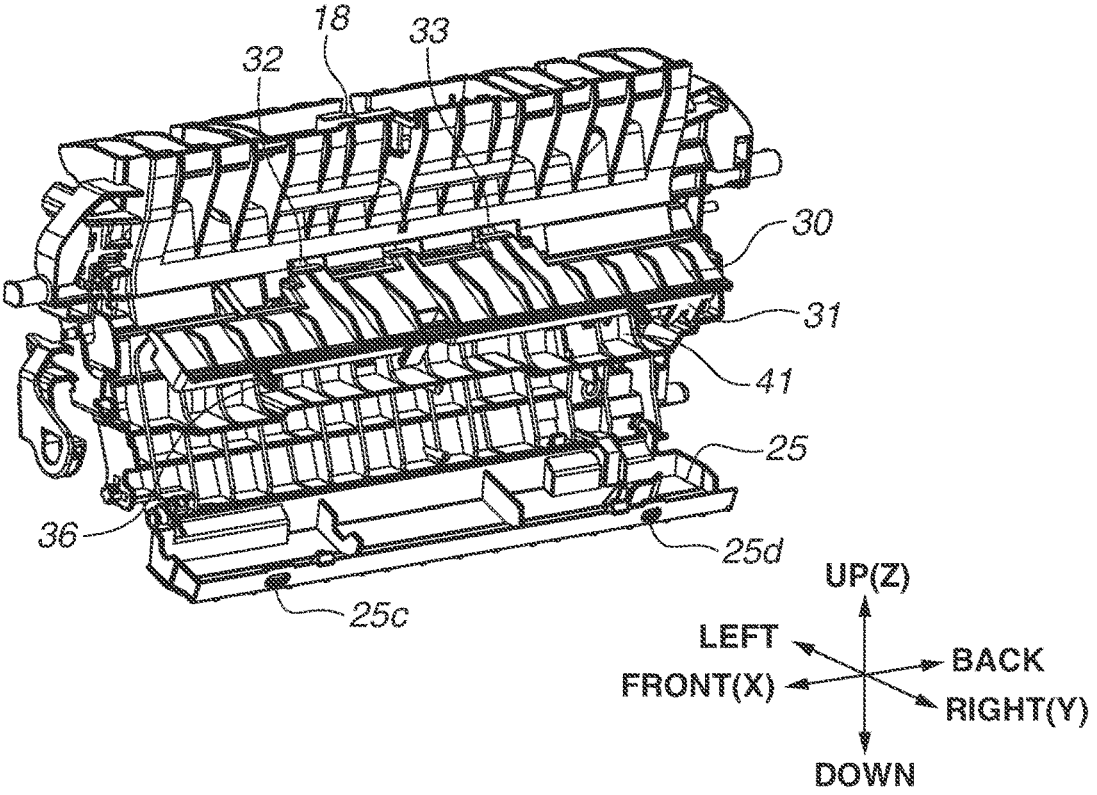
FIGS. 6A and 6B are perspective views illustrating a process of attaching the detachable guide to the secondary transfer unit.
Figure 6B:
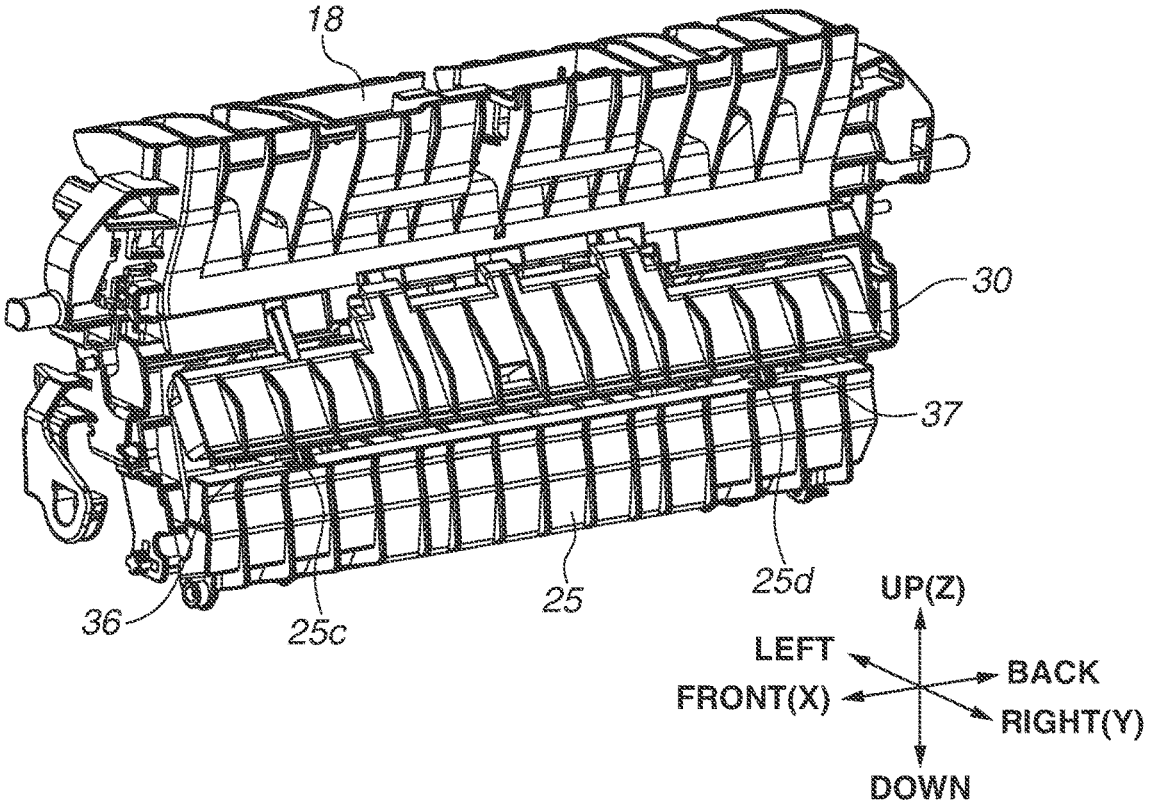

Next, a procedure for attachment of the detachable guide 30 will be described. FIGS. 6A and 6B each illustrate a perspective view of the detachable guide 30 in the process of being attached. First, as illustrated in FIG. 6A, the conveyance guide 25 is set in an open state with respect to the secondary transfer unit 18. Subsequently, the retention ribs 32 and 33 of the detachable guide 30 are inserted into the hole portions 44 and 45 of the secondary transfer unit 18, respectively, and the detachable guide 30 is moved to engage the rib 31 of the detachable guide 30 with the rib 41 of the secondary transfer unit 18. Simultaneously with this work, the conveyance guide 25 is rotated in a direction for attachment to the secondary transfer unit 18, so that the retention ribs 36 and 37 of the detachable guide 30 are inserted into hole portions 25*c* and 25*d* of the conveyance guide 25 as illustrated in FIG. 6B. Finally, the ribs 34 and 35 of the detachable guide 30 are engaged with the recess portions 42 and 43 of the secondary transfer unit 18 by pressing the detachable guide 30 and the conveyance guide 25 leftward in the y-direction, and the engagement claw 38 of the detachable guide 30 is engaged with the hole portion 46 of the secondary transfer unit 18 by further pressing the detachable guide 30 and the conveyance guide 25. The detachable guide 30 can be attached to the secondary transfer unit 18 by the above-described attachment procedure.

Owing to the use of the configuration of the present exemplary embodiment, a part including the contact portion to be in hard contact with the sheet S can be configured as the detachable guide 30 detachable from the secondary transfer unit 18, while high rigidity of the entire secondary transfer unit 18 serving as the conveyance guide unit is maintained. Because the filler is not added to the detachable guide 30, it is possible to prevent a fall of the filler from the secondary transfer unit 18 even if the sheet S comes into contact with the contact portion U, so that occurrence of an image defect can be prevented.

Figure 7:
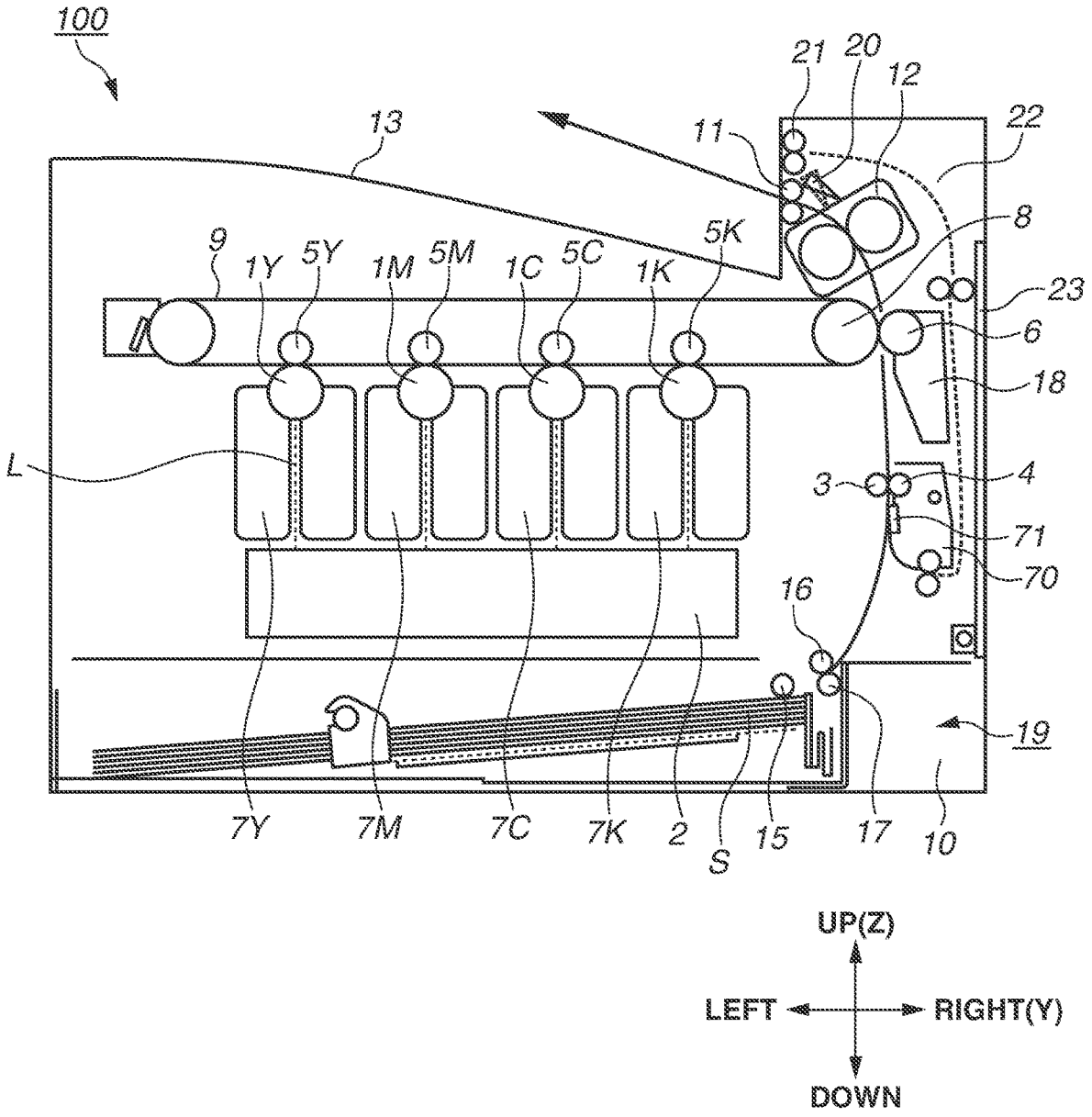
FIG. 7 is a schematic cross-sectional view of an overall apparatus configuration according to a modification example of the first exemplary embodiment.

In the present exemplary embodiment, the secondary transfer unit 18 is described as the conveyance guide unit, but the present exemplary embodiment is also applicable to other type of conveyance guide unit. For example, the present exemplary embodiment may be applied to a registration guide unit 70 including a detachable guide 71 having a contact portion that comes into hard contact with the sheet S, as illustrated in FIG. 7. The registration guide unit 70 is a conveyance guide unit that includes the registration roller 4 serving as a rotary member to be urged by an urging member (not illustrated) and the registration roller 3 serving as a roller facing the registration roller 4. The registration roller 4 is urged with a strong force as with the secondary transfer roller 6, and thus, it may be desirable for the registration guide unit 70 to have high rigidity as with the secondary transfer unit 18. In a case where the sheet S comes into contact with a part of the detachable guide 71 and the detachable guide 71 is abraded thereby, the detachable guide 71 may be detached from the registration guide unit 70 for replacement, as with the detachable guide 30.

In a second exemplary embodiment, there will be described a configuration in which the detachable guide 30 is detached from the secondary transfer unit 18 serving as the conveyance guide unit of the first exemplary embodiment, and an image reading unit 50 is attached in place of the detachable guide 30. In the following description, configurations similar to those of the first exemplary embodiment are assigned the same reference numerals as the first exemplary embodiment, and the description thereof will be omitted.

As with the first exemplary embodiment, at a point in hard contact with the sheet S, the sheet S is pressed against the conveyance surface and thus the conveyance state of the sheet S is stable. Therefore, image information representing an image formed on the sheet S can be stably read by disposing an image reading unit 50 opposite the conveyance path with a glass interposed therebetween. From the read image information, a failure part of the entire image forming apparatus can be identified or a sign of a failure can be detected.

Figure 8:
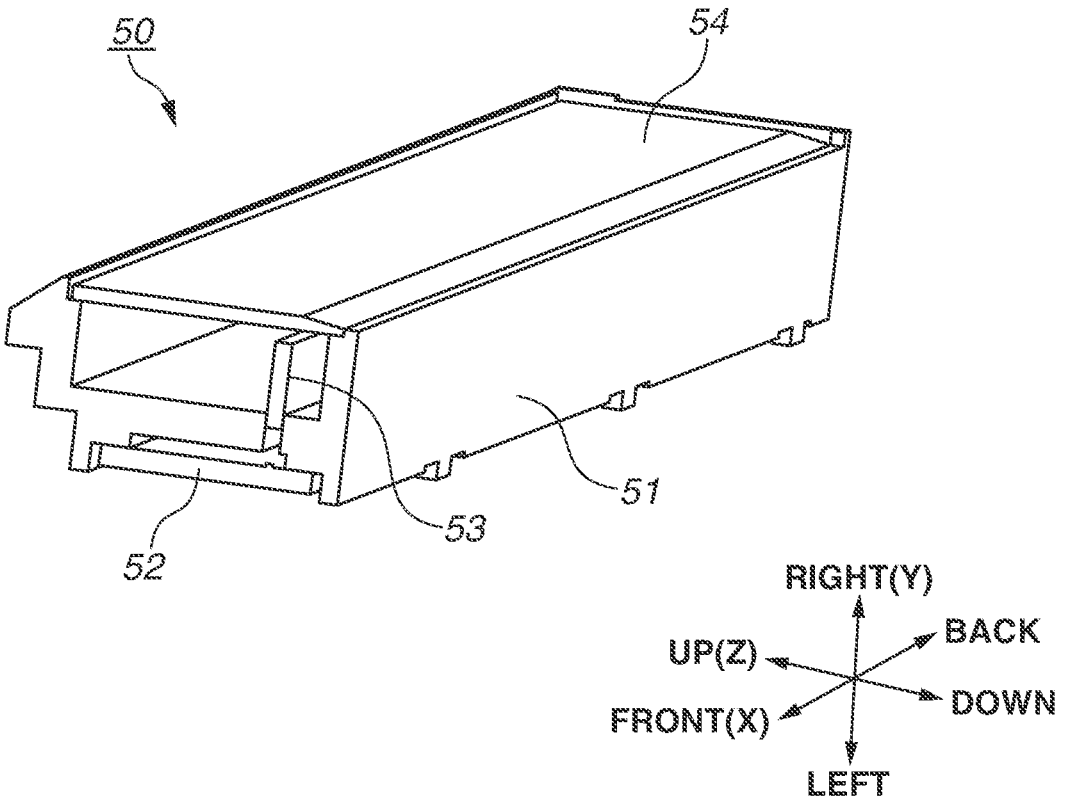
FIG. 8 is a perspective view of an image reading unit including a cross section thereof.

FIG. 8 is a cross-sectional view of the image reading unit 50 attachable to the secondary transfer unit 18. The image reading unit 50 includes a housing 51 serving as the main body of the image reading unit 50, an electric substrate 52 including an image sensor, a rod lens array 53, a contact glass 54, and a light source (not illustrated).

Figure 9:
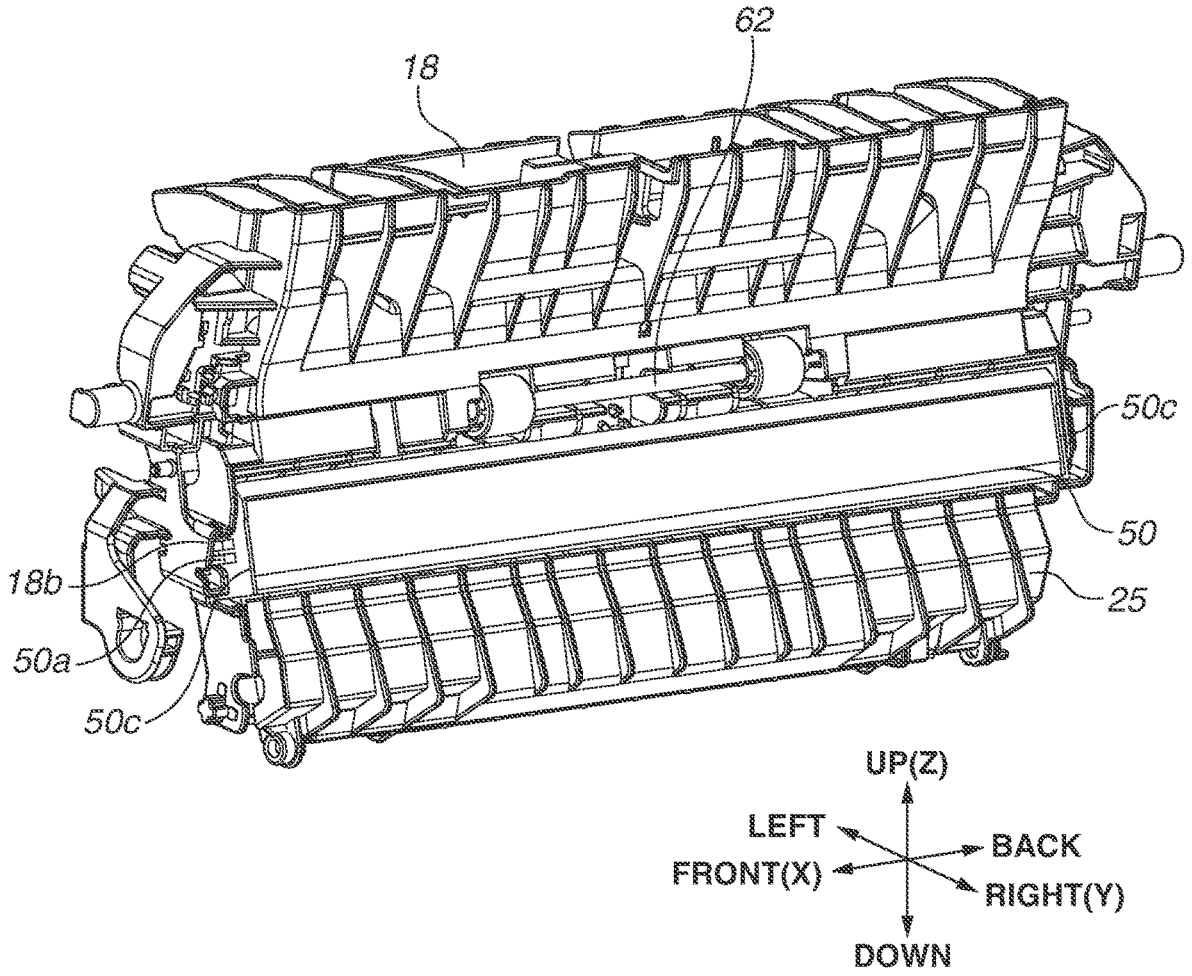
FIG. 9 is a perspective view of a configuration in which the image reading unit is attached to the secondary transfer unit.
Figure 10:
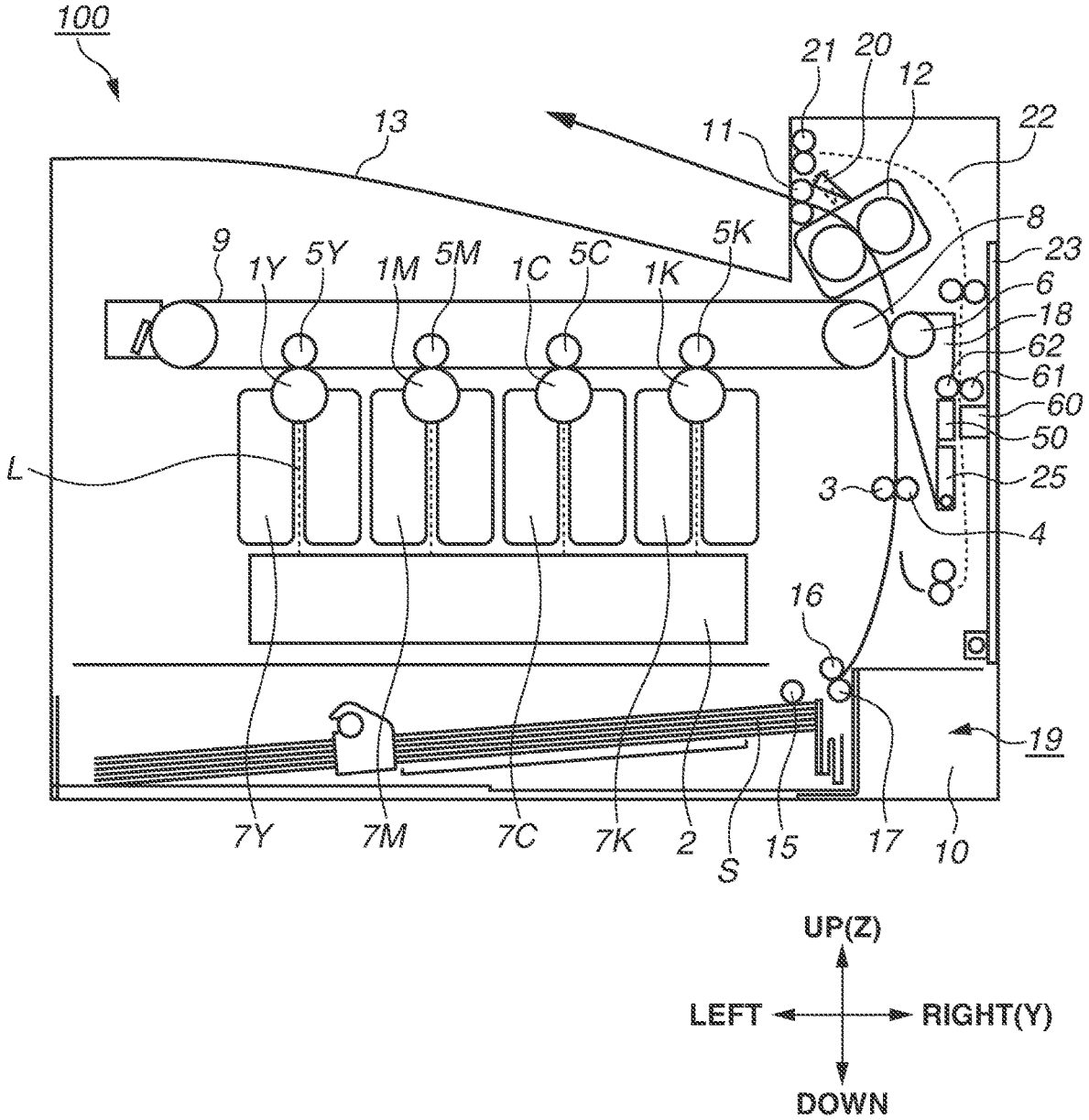
FIG. 10 is a cross-sectional view of the entire image forming apparatus to which the image reading unit is attached.
Figure 11:
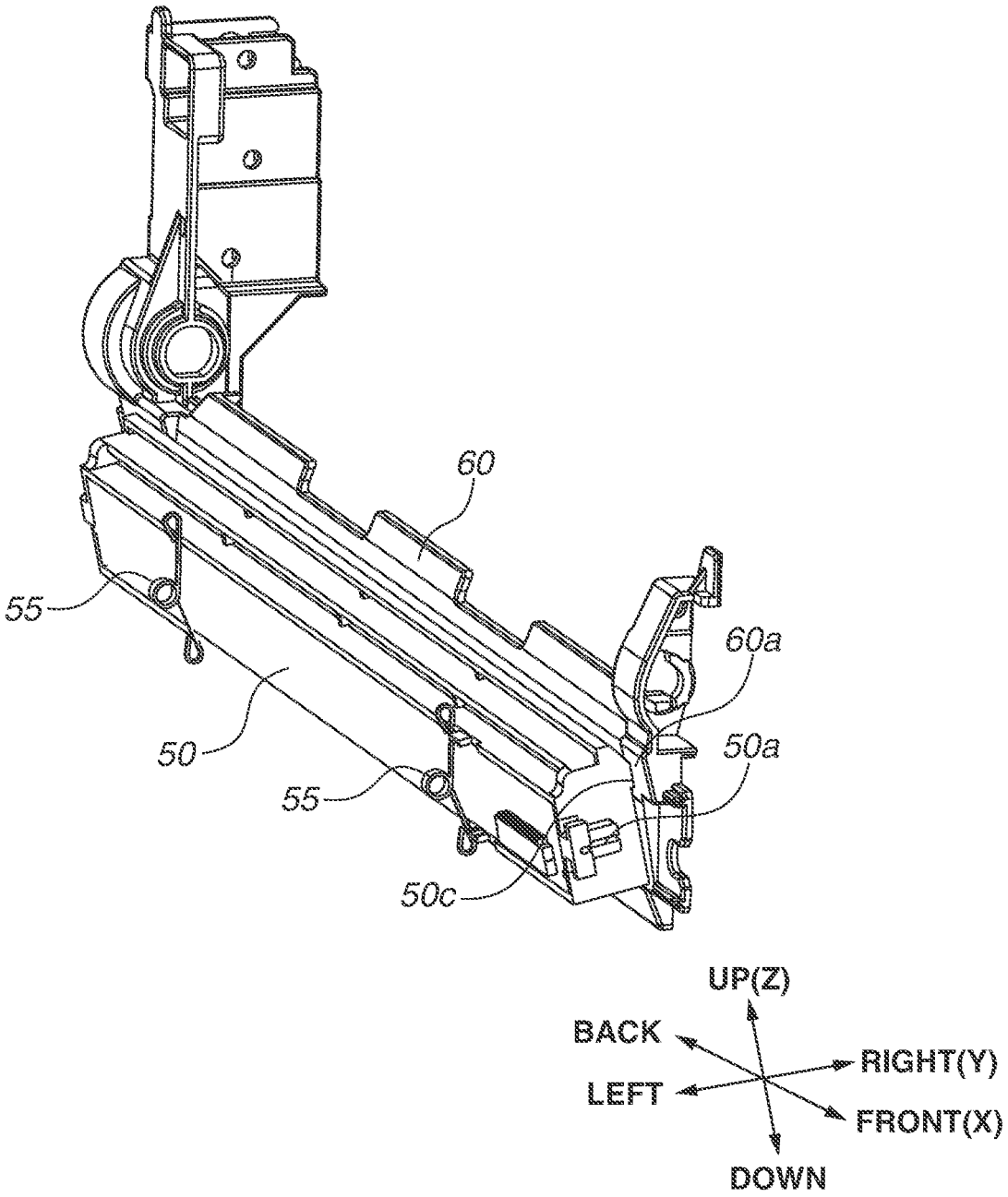
FIG. 11 is a perspective view of components related to the image reading unit.
Figure 12:
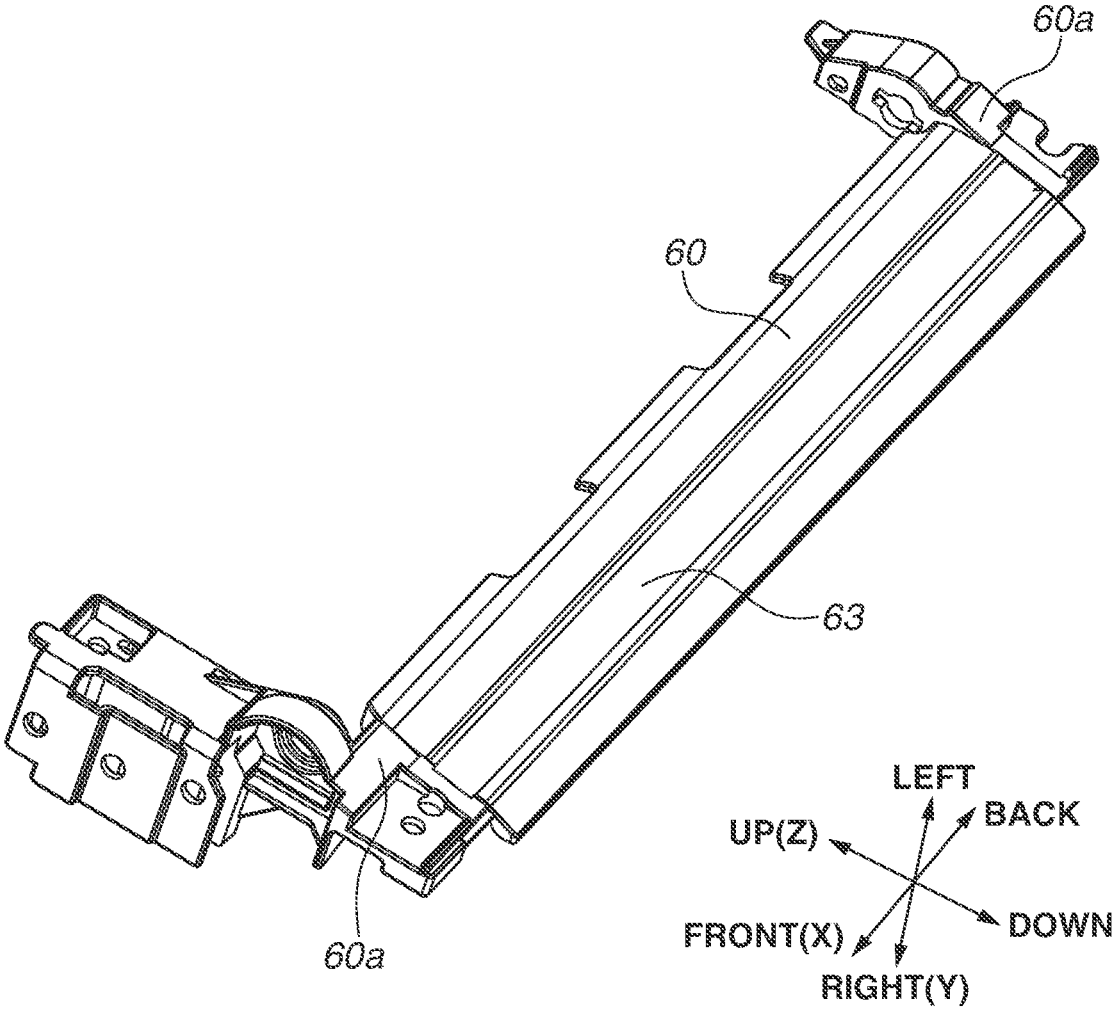
FIG. 12 is a perspective view of a white reference board.
Figure 13A:
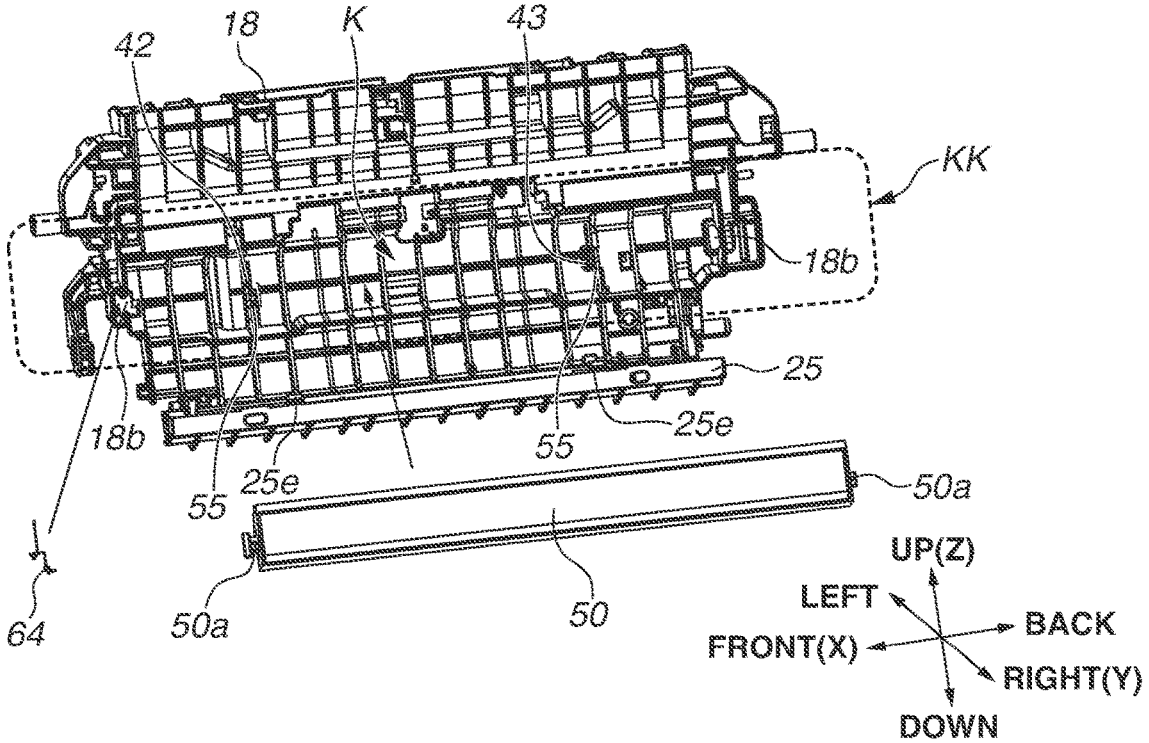
FIG. 13A is a perspective view illustrating a relationship between the image reading unit and the secondary transfer unit.
Figure 13B:
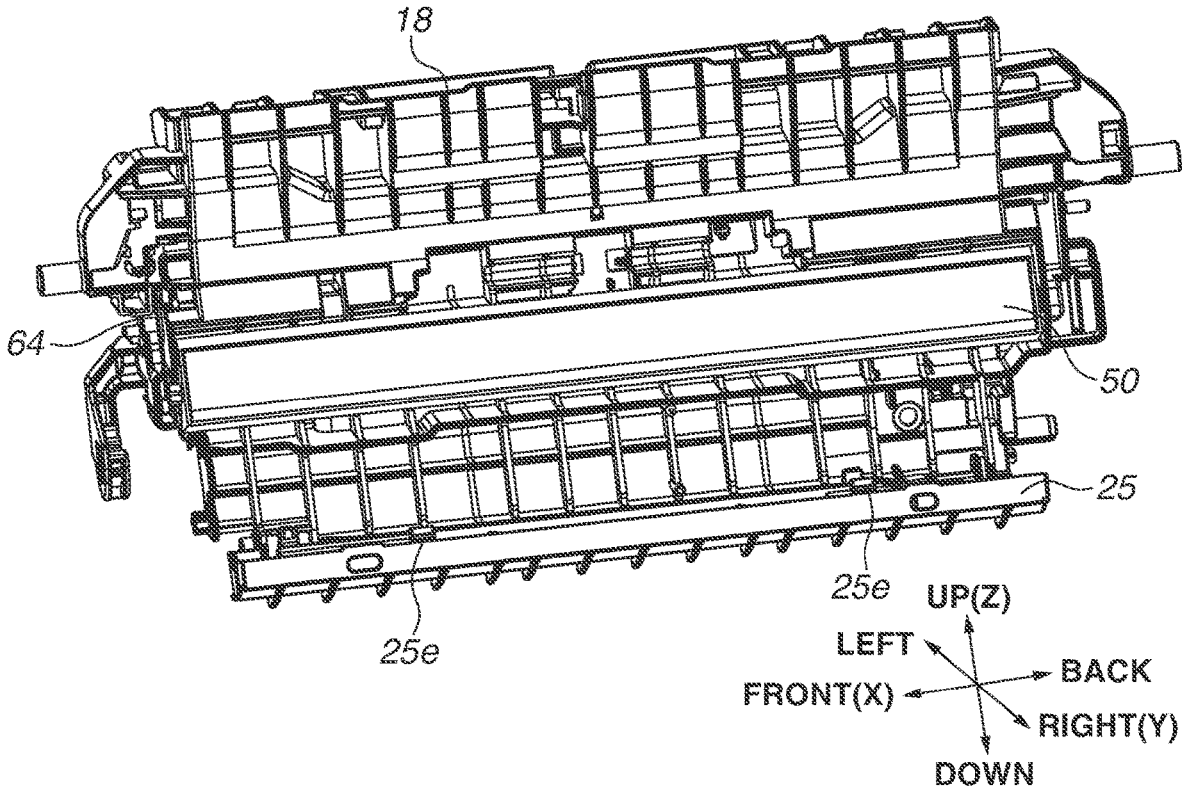
FIG. 13B is a perspective view illustrating a state where the image reading unit is attached to the secondary transfer unit.

FIG. 9 illustrates a perspective view of the image reading unit 50 attached to the secondary transfer unit 18. This is a perspective view illustrating a state where the image reading unit 50 is attached to the secondary transfer unit 18 of the first exemplary embodiment after the detachable guide 30 is removed therefrom. FIG. 10 is a cross-sectional view of the entire image forming apparatus 100 to which the image reading unit 50 is attached. FIG. 11 illustrates a perspective view of components related to the image reading unit 50, and FIG. 12 illustrates a perspective view of a white reference board 60. FIG. 13A is a perspective view illustrating a relationship between the image reading unit 50 and the secondary transfer unit 18, and FIG. 13B is a perspective view illustrating a state where the image reading unit 50 is attached to the secondary transfer unit 18.

As illustrated in FIG. 11, the white reference board 60 faces the contact glass 54 of the image reading unit 50. A white resin sheet 63 is affixed to a surface of the white reference board 60 to be used as a reference color for image reading. Instead of affixing the resin sheet, molding a white resin may be adopted.

The image reading unit 50 is slidable relative to the secondary transfer unit 18 by engaging a protrusion 50*a* with a recess portion 18*b* (see FIG. 13A) of the secondary transfer unit 18. Further, the image reading unit 50 is urged by a torsion coil spring 55 in each of the recess portions 42 and 43 (see FIG. 13A) of the secondary transfer unit 18, in a direction toward the white reference board 60. Therefore, an abutting portion 50*c* of the image reading unit 50 and an abutting portion 60*a* of the white reference board 60 constantly abut each other. Because the abutting portion 50*c* of the image reading unit 50 and the abutting portion 60*a* of the white reference board 60 constantly abut each other, a space of the conveyance path of the image reading unit 50 can be maintained appropriately, so that the accuracy of image reading can be improved. In the present exemplary embodiment, a space of about 0.5 mm is formed between the image reading unit 50 and the white reference board 60, so that focus for reading is achieved by suppressing flapping of the sheet S.

Further, as illustrated in FIG. 9, a conveyance idler roller 62 is disposed upstream from the image reading unit 50, so that the sheet S is brought into hard contact with the contact glass 54 of the image reading unit 50, and the flapping of the sheet S is thereby further suppressed. An upstream conveyance roller 61 to be rotated by a driving force transmitted from a drive source is at a position facing the conveyance idler roller 62.

The white reference board 60 is fixed to the opening/closing door 23, so that the white reference board 60 and the contact glass 54 of the image reading unit 50 can be accessed and cleaned when the opening/closing door 23 is open.

How to attach the image reading unit 50 will be described. FIGS. 13A and 13B each illustrate a perspective view of the image reading unit 50 in the process of being attached. As illustrated in FIG. 13A, in a state where the detachable guide 30 is not attached to the secondary transfer unit 18, a space K is formed inside the secondary transfer unit 18. The secondary transfer unit 18 includes an attachment portion KK to which the image reading unit 50 can be attached, in the space K.

The conveyance guide 25 is set in an open state with respect to the secondary transfer unit 18 as illustrated in FIG. 13A, and the torsion coil spring 55 serving as an urging member is disposed and positioned in each of the recess portions 42 and 43 of the secondary transfer unit 18. Here, the recess portions 42 and 43 of the secondary transfer unit 18 are used as the positioning portion for positioning the detachable guide 30 in the z-direction by engaging with the ribs 34 and 35 of the detachable guide 30, in the first exemplary embodiment.

In other words, the recess portions 42 and 43 of the secondary transfer unit 18 are the positioning portion for the detachable guide 30 and a positioning portion for the urging member for the image reading unit 50, and therefore are members serving as a positioning portion for two members.

The protrusion 50*a* on the back side in the x-direction of the image reading unit 50 is inserted into the recess portion 18*b* on the back side in the x-direction of the secondary transfer unit 18, and then the protrusion 50*a* on the front side in the x-direction is also similarly inserted into the recess portion 18*b* on the front side in the x-direction. Subsequently, as illustrated in FIG. 13B, a clip 64 serving as a holding member is attached to hold the image reading unit 50. In the present exemplary embodiment, a spring is used for the clip 64, but a material such as a resin may be used. Here, the attachment portion KK is composed of the recess portions 42 and 43 and the recess portion 18*b* of the secondary transfer unit 18 of the present exemplary embodiment.

Finally, the conveyance guide 25 is rotated to engage an engagement claw 25*e* of the conveyance guide 25 with the image reading unit 50, so that the image reading unit 50 is attached. The engagement claw 25*e* has a hook shape, so that the image reading unit 50 can be attached by snap-fitting, and thus the conveyance guide 25 and the image reading unit 50 can be easily engaged with each other.

The present exemplary embodiment is described to provide the configuration in which the detachable guide 30 attached to the secondary transfer unit 18 in the first exemplary embodiment is replaced with the image reading unit 50. Thanks to this configuration, the image reading unit 50 can be set as an option to be used later. Because the detachable guide 30 is replaced with the image reading unit 50, a replaceable unit can be smaller than in a case where the entire secondary transfer unit 18 is replaced, so that usability in replacement can be improved.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-119404, filed Jul. 10, 2020, which is hereby incorporated by reference herein in its entirety.

What is claimed is:

1. An image forming apparatus comprising:

an image forming unit configured to form an image on a sheet;

a conveyance guide unit configured to convey the sheet on which the image is to be formed by the image forming unit; and a conveyance unit configured to convey the sheet toward a first conveyance guide unit, wherein the conveyance guide unit includes an urging member, a rotary member configured to be urged by the urging member and to rotate while abutting the sheet, a holding unit holding the urging member and the rotary member, and the first conveyance guide unit that is detachably attached to the holding unit to guide the sheet, and wherein the first conveyance guide unit includes a pressed portion, and the pressed portion is to be pressed by the sheet conveyed by the conveyance unit and has strength less than strength of the holding unit.

2. The image forming apparatus according to claim 1, wherein the holding unit includes a molded resin to which a filler is added, and wherein the first conveyance guide unit includes a molded resin to which the filler is not added.

3. The image forming apparatus according to claim 2, wherein the image forming unit includes an intermediate transfer belt to which a toner image is to be primarily transferred from a photosensitive member, and wherein the rotary member abuts the intermediate transfer belt, and forms a secondary transfer portion for secondarily transferring the toner image from the intermediate transfer belt to the sheet.

4. The image forming apparatus according to claim 3, wherein the image forming apparatus is configured to convey the sheet having a formed image to the secondary transfer portion again, via a two-sided conveyance path, and wherein the first conveyance guide unit forms a part of the two-sided conveyance path.

5. The image forming apparatus according to claim 1, wherein the conveyance guide unit further includes a second conveyance guide unit located downstream from the first conveyance guide unit in a conveyance direction for the sheet guided by the first conveyance guide unit, and the second conveyance guide unit guides the sheet.

6. The image forming apparatus according to claim 5, wherein the first conveyance guide unit is held by the holding unit and the second conveyance guide unit.

7. The image forming apparatus according to claim 1, wherein the holding unit includes an attachment portion which is in a space formed by detachment of the first conveyance guide unit and to which an image reading unit, configured to read the image formed on the sheet, is attachable.

8. An image forming apparatus comprising:

an apparatus main body including a photosensitive member configured to support a toner image;

an intermediate transfer belt onto which the toner image is primarily transferred from the photosensitive member;

a secondary transfer unit including a secondary transfer roller urged toward the intermediate transfer belt and configured to secondarily transfer the toner image from the intermediate transfer belt to a sheet; and a reversing roller pair configured to convey the sheet, onto which the toner image has been secondarily transferred from the intermediate transfer belt, toward the intermediate transfer belt again, wherein the secondary transfer unit includes a holding member configured to hold the secondary transfer roller and a detachable guide detachably attachable to the secondary transfer unit and configured to guide the sheet reversed by the reversing roller pair, a strength of the detachable guide being less than a strength of the holding member.

9. The image forming apparatus according to claim 8, wherein the holding member is formed by resin to which a filler is added, and wherein the detachable guide is formed by resin to which the filler is not added.

10. The image forming apparatus according to claim 9, further comprising a conveyance roller pair configured to convey the sheet received from the reversing roller pair toward the detachable guide between the reversing roller pair and the detachable guide in a sheet reversing direction of the reversing roller pair.

11. The image forming apparatus according to claim 10, further comprising an engagement member rotatable with respect to the holding member and configured to engage with the detachable guide downstream of the detachable guide in the sheet reversing direction of the reversing roller pair.

* * * * *